United States Patent [19]

Hutchinson et al.

[11] 4,280,692

[45] Jul. 28, 1981

[54] CASSETTE WITH LOCKABLE LIFT PLATE

[75] Inventors: Peter Hutchinson; Henry T. Pauk, both of Nashua, N.H.

[73] Assignee: Nashua Corporation, Nashua, N.H.

[21] Appl. No.: 123,389

[22] Filed: Feb. 21, 1980

[51] Int. Cl.[3] ..... B65H 1/12

[52] U.S. Cl. ..... 271/160; 271/127; 271/164; 271/170; 271/171

[58] Field of Search ..... 271/127, 160, 164, 162, 271/163, 170, 171; 292/145, 175

[56] References Cited

U.S. PATENT DOCUMENTS

| | | | |
|---|---|---|---|
| 1,462,657 | 7/1923 | Rainalter | 292/175 |
| 3,672,665 | 6/1972 | Schnall et al. | 271/164 |
| 4,017,181 | 4/1977 | Komaba et al. | 271/127 X |
| 3,905,6975 | 9/1975 | Komori et al. | 271/160 X |

OTHER PUBLICATIONS

Campbell, J. L. et al. *IBM Technical Disclosure Bulletin,* vol. 17, No. 3, Aug. 1974, pp. 670–671.

*Primary Examiner*—Bruce H. Stoner, Jr.
*Attorney, Agent, or Firm*—Kenway & Jenney

[57] ABSTRACT

A photocopier tray cassette lift plate is lockable against the upward bias of its springs by a tab extending down to engage a lower latch member mounted to the tray base. The lower latch member is spring biased toward a position in which it may engage the tab, and is movable toward a disengaging position by a forwardly projecting surface that engages the photocopier frame upon insertion of the tray.

2 Claims, 5 Drawing Figures

CASSETTE WITH LOCKABLE LIFT PLATE

BACKGROUND

This invention relates generally to sheet holding tray cassettes for photocopy machines, and particularly to cassettes with upwardly biased lift plates on which sheets are stacked to be fed into the photocopier.

Many photocopy machines provide for paper to be supplied to the machine from removable trays. The trays are generally filled outside the machine and are then inserted into the machine where they cooperate with feeding elements for transporting the sheets into the photocopier. The sheet feed discharge position in the photocopier is ordinarily substantially fixed. The feeding elements generally act on the top sheet of the paper stack, and the position of the top sheet must be maintained as sheets are discharged from the tray and the size of the stack decreases. Thus, the stack must be raised in some way, in a fairly continuous manner, to maintain the same vertical position of the top sheet of the stack.

One common way to maintain a constant discharge position is to support the paper stack on a lift plate that is spring biased upwardly. In a tray cassette, the lift plate may be upwardly pivotable about its rear edge in response to springs disposed between it and the bottom plate of the tray. Importantly, the spring constant of the springs is chosen so that the top of the stack, whether full or substantially empty, remains generally in the same vertical position.

When a spring loaded tray cassette is filled with a sheet material, the spring force urging upward the lift plate on which the stack is placed must be overcome. This can be both awkward and inconvenient, especially if the spring force is large. Thus it may be inconvenient to load the paper so that it lies in a properly aligned position beneath, for example, the corner separators.

Accordingly, it is an object of the invention to provide a tray cassette with an upwardly biased lift plate, on which sheets are stacked, that is convenient to load. Other objects are to provide such a tray cassette that has a minimum of additional mechanical parts, and that operates in conjunction with the photocopier frame to minimize the mechanical operations that an operator must do in loading the cassette.

SUMMARY OF THE INVENTION

This invention provides a first latch on the paper lift member of a photocopier sheet holding tray and a second latch mounted on the tray frame. The first and the second latch members are engageable to maintain the paper lift member in a paper loading condition against the upward bias of the paper lift member; the locking engagement is releasable to allow the paper lift member to move to a paper feeding condition.

In preferred embodiments, the first latch member is a downwardly, rearwardly extending tab formed from a portion of the lift plate of the photocopier tray. A latch housing is mounted on the bottom of the tray below the tab, and includes fixed, upright, vertical front and rear walls, each defining an aperture through a rod is slidably, horizontally movable between a first and a second position. A latch head is fixed on the rod. The latch head has an upper camming surface disposed to urge the head rearwardly when engaged by the tab when the paper lift plate is urged downwardly and the latch head is in the first position; the latch head also has a locking surface for engaging the tab to maintain the paper lift plate in a paper loading position.

A coil spring coaxial with the rear portion of the rod member extending from the latch head through the rear wall aperture urges the latch head in a forward position, a stop on the rod cooperating with one of the walls to limit the forward movement. A surface at the front of the front portion of the rod member is engageable with a cooperating surface of the photocopier when the tray is inserted into its operative position, moving the latch head locking surface out of engagement with the tab.

BRIEF DESCRIPTION OF THE DRAWINGS

Other objects, features and advantages of the invention will be apparent from the following description of a preferred embodiment, including the drawings thereof, in which.

DESCRIPTION OF THE PREFERRED EMBODIMENT

Figure 1:
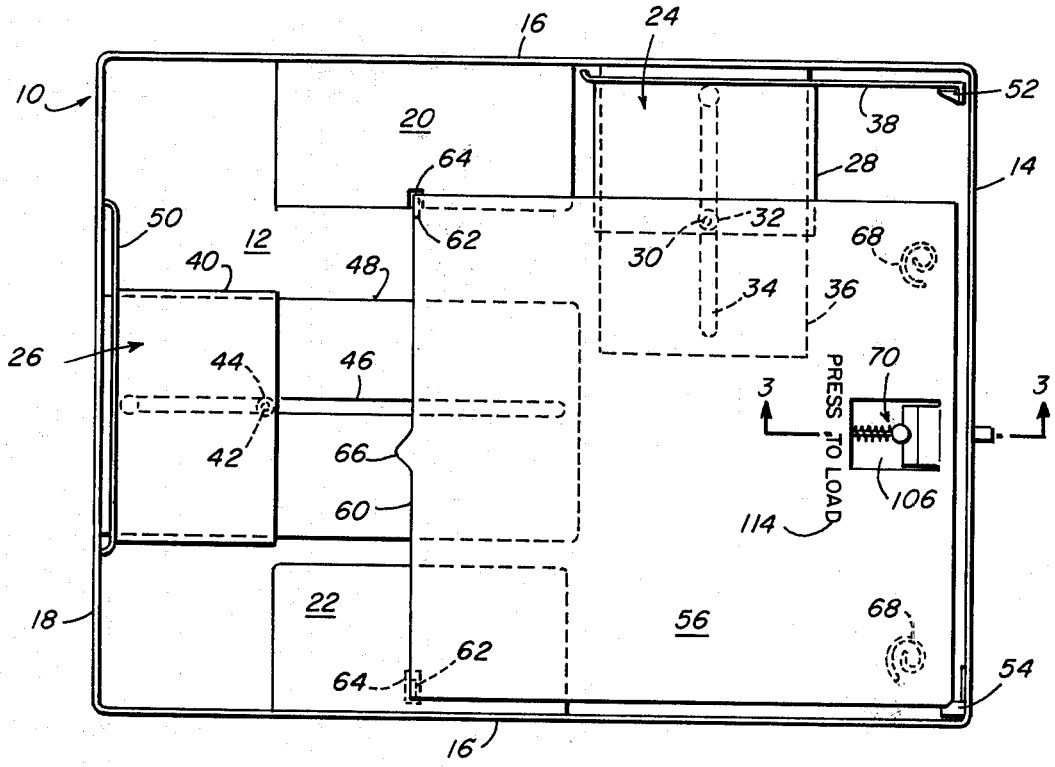
FIG. 1 is a plan view of a photocopier tray cassette.
Figure 2:
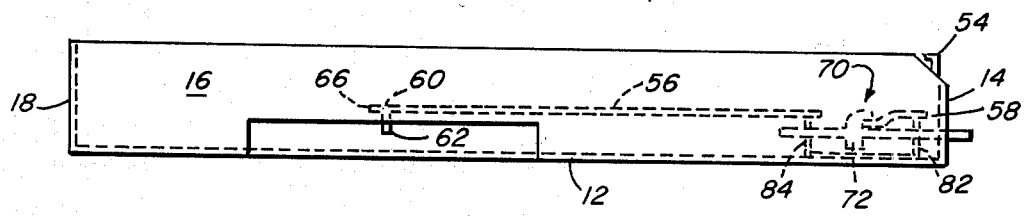
FIG. 2 is a side elevation view of the tray cassette of FIG. 1.

A tray 10, suitable for use in storing a stack of sheets of copy material, typically paper, and for insertion into a photocopier, is shown in FIGS. 1 and 2. The illustrated tray is defined by a frame having a bottom wall 12, a front wall 14, side walls 16, and a back wall 18. The interior of the tray includes raised stack support portions 20 and 22. It also includes a side guide 24 and a rear guide 26. The side guide 24 includes a horizontal metal sleeve 28 with downwardly projecting fasteners 30 with nuts 32 cooperating with a slot 34 in a plastic slide 36 on which the metal sleeve 28 is slidable. The side guide 24 includes a vertical wall 38 for adjusting the width of the sheet stack area in the tray 10. The rear guide 26 similarly includes a horizontal metal sleeve 40 with fasteners 42 and nuts 44 cooperating with a slot 46 in a rear plastic slide 48. The rear guide 26 has a vertical wall 50 for adjusting the length of the sheet stack area of the tray 10.

The vertical wall 38 of the side guide 24 includes at its forward end (shown near a front corner of the tray 10) a corner separator member 52, engageable with sheets stacked in the tray 10 when the wall 38 is brought up against the side of the stack by sliding the sleeve 28 on the slide 36. Another corner separator member 54 is mounted on the other front corner on the tray front wall 14 near the side wall 16.

A lift plate 56 has a front edge 58 near the tray front wall 14. A rear edge 60 of the lift plate 56 has downwardly extending tabs 62 resting in slots 64 in the stack support portions 20, 22 so that the lift plate 56 is pivotable about its rear edge 60. The rear edge 60 of the lift plate 56 includes a centrally positioned, rounded projecting portion 66, which rests on the upper surface of the metal sleeve 40 of the rear guide 26 when the metal sleeve 40 is pushed forward from the rearmost position shown in FIG. 1 to a forward position corresponding to the length of paper to be placed in the cassette. Two lift plate springs 68 are located between the lift plate 56 and the tray bottom 12. They are located generally near the forward corners of the tray bottom 12 to provide an upward bias to the lift plate 56 so that the top of a sheet stack on the lift plate 56 will be positioned against the bottom surfaces of separators 52, 54, where it can be engaged by the feeding apparatus of the photocopier.

Figure 3:
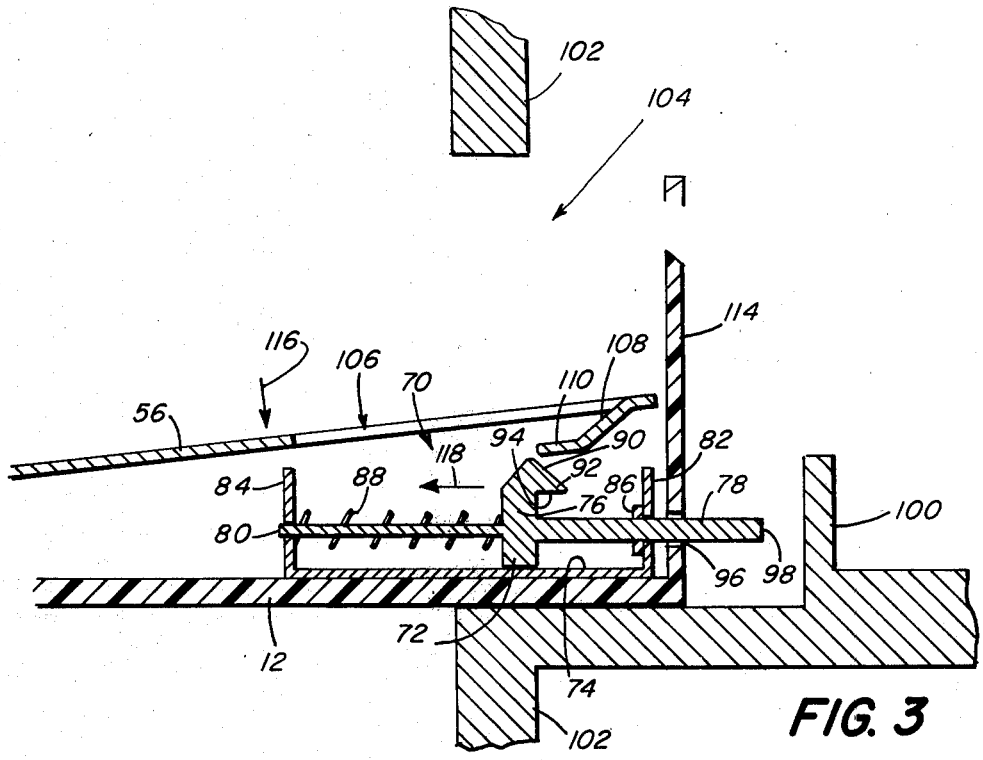
FIG. 3 is a side sectional view of the latching apparatus of the tray cassette before the lift plate is locked.
Figure 4:
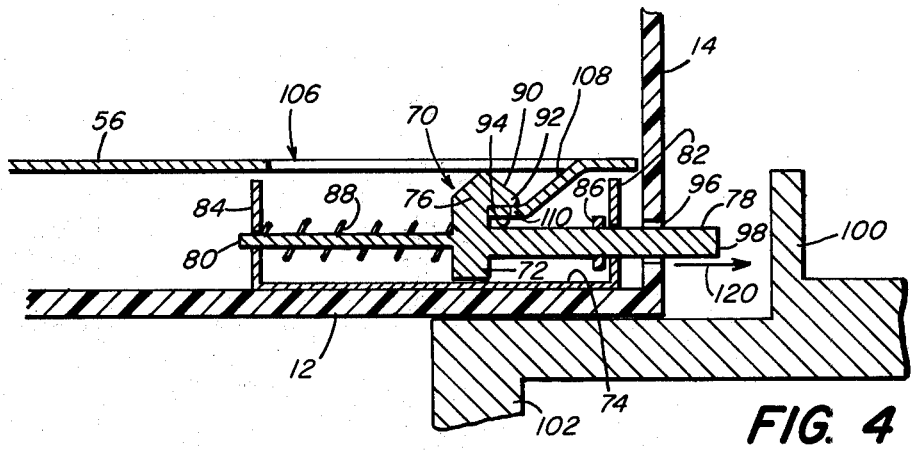
FIG. 4 is a view like that of FIG. 3 in which the lift plate is locked.
Figure 5:
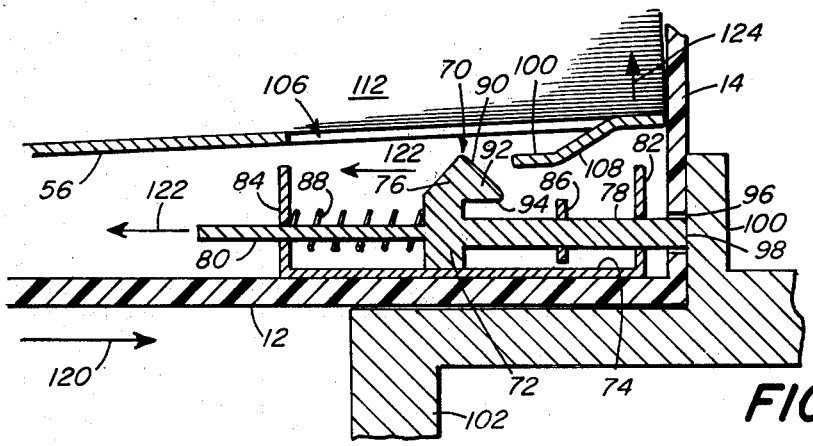
FIG. 5 is a view like that of FIG. 3 in which the lift plate is released from its locked position.

The latching apparatus 70 for locking the lift plate 56 in a downward position against the bias of the springs 68 is shown in the forward part of the tray 10 in FIGS. 1 and 2, and is shown in greater detail in FIGS. 3–5.

The illustrated latching apparatus 70 includes a lower latch member 72 contained in a latch housing 74 attached to the tray bottom 12 underneath a front central portion of the lift plate 56. The lower latch member 72 includes a head 76 from which extends front 78 and rear 80 rods slidable through front 82 and rear 84 walls, respectively, of the latch housing 74. The front rod 78 has a vertical stop rod 86 inserted therethrough, between the front wall 82 and head 76, to prevent passage of the front rod 78 in a forward direction beyond the position at which stop rod 86 meets the front wall 82. A compression spring 88 is wound around the rear rod 80 inside the housing 74, biasing the latch member head 76 forward toward wall 82.

The latch head 76 has a downwardly sloping front upper camming surface 90 terminating in a forward nose portion 92 having a horizontal under latch surface 94. The illustrated latch head 76 is movable in the horizontal direction between front and rear positions, and is biased toward the front position by the compression spring 88. The front rod 78 of the latching apparatus 70 extends through the latch housing front wall 82 through an opening 96 in the front wall 14 of the tray 10. The front rod 78 projects beyond wall 14 to where its front surface 98 can meet a portion 100 of the photocopier frame 102 when it is inserted into the receiving opening 104 of the photocopier frame after being stacked with paper.

In the illustrated embodiment, the front portion of the lift plate 56 forms the upper latch member of the latching apparatus 70. The lift plate 56 has an aperture 106 in its front portion just over the lower latch member 72. The lift plate 56 includes a downwardly extending tab 108 terminating in a generally horizontal, rearwardly extending upper latch surface 110.

In operation of the photocopier, the tray 10 must be removed from the photocopier frame 102 and reloaded by stacking paper 112 on the lift plate 56. When the tray 10 is removed from the photocopier, the positions of the lift plate 56 and the latching apparatus 70 are generally as shown in FIG. 3. The lower latch member head 76 is biased in the forward position because of the compression spring 88. The lift plate tab 108 is out of contact with the lower latch member head 76 because of the upward bias of the lift plate springs 68 on plate 56.

Placing downward pressure on the front portion of the lift plate 56 (as indicated by the words 114 printed on the lift plate) in the direction shown by the arrow 116 causes the lift plate tab 108 to slide down the front upper surface 90 of the lower latch head 76 in a camming action that forces the lower latch head 76 rearwardly (in the direction shown by the arrow 118) against the bias of the compression spring 88. After sliding completely down the latch head upper surface 90, the upper surface of tab 108 is engaged by the lower horizontal under surface 94 of the lower latch head 76 (as head 76 becomes free to move forward toward wall 14), and the lift plate 56 is locked in a lowered position against the bias of the lift plate springs 68 (see FIG. 4).

The tray 10 may be stacked with sheets 112 conveniently while the lift plate 56 is locked in this lowered position. After the stack 112 is loaded, the tray 10 is inserted into the receiving opening 104 of the photocopier frame 102. When this is done, the front rod 78 of the latch assembly 70, projecting forwardly of the tray front wall 14, meets the portion 100 of the photocopier frame 102 defining the end of the receiving opening 104. Insertion of the tray 10 into the opening 104 (in the direction of the arrow 120 (FIG. 4)) causes the rod's front surface 98 to engage the frame portion 100 and move the latch head 76 rearwardly (in the direction of the arrows 122 (FIG. 5)). As the latch head 76 moves in the direction of arrows 122, the under surface 94 of the latch head 76 disengages from the lift plate tab 108 and the lift plate 56 moves upwardly (in the direction of the arrow 124) until the corners of the top sheet of paper engage corner separators 52, 54. As seen from FIG. 5, the lift plate 56 is now in a position to respond, unimpeded by the latch head, to the lift plate springs 68.

SUMMARY OF THE ADVANTAGES OF THE INVENTION

The invention provides a positive locking procedure that is consistent with the motions of filling and loading the paper stack in a removable tray and provides a particularly convenient apparatus for loading paper sheets. The lift plate is locked by pressing it down in a motion complementary to adding paper to the tray. The lift plate may even be locked with paper still in the tray, since the paper stack can transmit the downward force necessary to lock the lift plate when the paper stack itself is pressed. The lift plate does not have to be unlocked after the paper loading operation is completed. The unlocking takes place automatically as the tray is inserted into the photocopier. The elements that make up this virtually automatic locking and unlocking procedure are nevertheless sturdy, reliable elements.

Some of the elements can be varied without affecting the invention. The exact configuration of the surfaces of the two latch members may be varied as long as a positive latch is achieved and as long as the surface of one of the latch members acts in camming engagement with the other to achieve engagement of the latch. Additions, subtractions, deletions, or other modifications of the illustrated embodiment will occur to those skilled in the art, and are to be considered to be within the scope of the invention, defined by the following claims.

I claim:

1. A photocopier sheet holding assembly comprising:

a tray for holding sheets of material in a stack and adapted to be inserted into a receiving opening in the frame of a photocopier for engagement of said sheets by sheet feeding apparatus, said tray being defined by a frame and having a front wall, a bottom, a paper lift plate mounted in said tray for pivotal movement about a rear edge of said member, and means for biasing said paper lift plate upwardly, wherein the improvement comprises:

a latching assembly having a first latch member comprising a downwardly, rearwardly extending tab formed from a portion of said paper lift plate, a second latch member including a latch head, and a latch housing mounted on said tray bottom beneath said tab comprising:

a fixed front upright vertical wall defining a first aperture, a fixed rear upright vertical wall defining a second aperture, a rod member mounted for horizontal, slidable movement through said apertures, between a first position and a second position, said latch head being mounted in a fixed position on said rod member, said rod member having a rear portion extending from said latch head through said rear wall aperture and a front portion extending from said latch head through said front wall aperture, said front portion terminating in a surface for engaging a cooperating surface of said photocopier when said tray is inserted into its operative position in said photocopier and disposed to move said latch head fixed on said rod member from said first position to said second position, when said tray is in its operative position, a coil spring coaxial with said rod member rear portion for urging said latch head in a forward direction, a stop means cooperating with said rod member and one of said upright vertical walls for limiting the movement of said latch head in a forward direction, said latch head having an upper camming surface disposed to urge said latch head rearwardly when engaged by said tab when said paper lift plate is urged downwardly, and said latch head fixed on said rod member is in said first position, and a locking surface for lockingly engaging said top to maintain said paper lift plate in a paper loading position, said locking surface being moved out of engagement with said tab when said latch head fixed on said rod member is in its second position.

2. A photocopier sheet holding assembly comprising:

a tray for holding sheets of material in a stack and adapted to be inserted into a receiving opening in the frame of a photocopier for engagement of said sheets by sheet feeding apparatus, said tray being defined by a frame and having a paper lift member mounted in said tray above a frame bottom wall for pivotal movement about a rear edge of said member, and means for biasing said paper lift member upwardly, wherein the improvement comprises:

a latching assembly having a first latch member mounted on said paper lift member, having a first camming surface, a second latch member mounted on said tray frame for movement between a first position wherein said second latch member can engage and maintain said first latch member in a paper loading condition and a second position wherein said second latch member is out of engaging and locking contact with said first latch member, comprising:

a latch head having a first surface for lockingly engaging said first latch member when said second latch member is in said first position, said first surface being moved out of engagement with said first latch member when said second latch member is in said second position, and a second camming surface disposed with respect to said first camming surface of said first latch member to urge said second latch member from its first position toward its second when said paper lift member is urged downward, a first horizontally directed forward rod member secured at one end to said latch head and defining at its other end a rod surface for engaging a cooperating surface of said photocopier when said tray is inserted into its operative position in said photocopier to move said second latch member from said first position to said second position when said tray is in its operative position, a second horizontally directed rearward rod member secured at one end to said latch head, means for mounting said second latching member for supporting and slideably passing therethrough said rearward member, bias means comprising a coil spring coaxial with said rearward member for urging said latch head in a forward direction, and stop means cooperating with said forward rod member for limiting the movement of said latch head in a forward direction.

* * * * *